US007871286B2

(12) United States Patent
Motohira et al.

(10) Patent No.: US 7,871,286 B2
(45) Date of Patent: Jan. 18, 2011

(54) FLAT MULTI-CONDUCTOR CABLE CONNECTOR

(75) Inventors: Katsuya Motohira, Tokyo (JP); Minoru Michita, Tokyo (JP); Ryo Kameoka, Kanagawa-Ken (JP); Akiyo Higuchi, Kanagawa-Ken (JP); Tom Katsurahara, Kanagawa-Ken (JP)

(73) Assignees: Stanley Electric Co., Ltd., Tokyo (JP); Union Machinery Co., Ltd., Sagamihara-Shi, Kanagawa-Ken (JP)

( * ) Notice: Subject to any disclaimer, the term of this patent is extended or adjusted under 35 U.S.C. 154(b) by 65 days.

(21) Appl. No.: 12/283,916

(22) Filed: Sep. 16, 2008

(65) Prior Publication Data

US 2009/0098761 A1 Apr. 16, 2009

(30) Foreign Application Priority Data

Sep. 19, 2007 (JP) ..... 2007-242090

(51) Int. Cl.
*H01R 4/05* (2006.01)

(52) U.S. Cl. ..... 439/404

(58) Field of Classification Search ..... 439/391, 439/405, 498, 403, 404

See application file for complete search history.

(56) References Cited

U.S. PATENT DOCUMENTS

| | | | | |
|---|---|---|---|---|
| 4,641,904 | A * | 2/1987 | Kosugi et al. | 439/404 |
| 4,682,836 | A * | 7/1987 | Noorily et al. | 439/426 |
| 5,009,612 | A * | 4/1991 | Rishworth et al. | 439/403 |
| 6,024,597 | A * | 2/2000 | Lok | 439/497 |
| 7,407,407 | B2 * | 8/2008 | Oesterhaus et al. | 439/404 |
| 2006/0232525 | A1 * | 10/2006 | Chou | 345/83 |

* cited by examiner

*Primary Examiner*—Alexander Gilman
(74) *Attorney, Agent, or Firm*—Flynn, Thiel, Boutell & Tanis, P.C.

(57) ABSTRACT

A flat multi-conductor cable connector comprises a main body and a back plate. Arc-shaped cross-section flat-multi-conductor-cable holding grooves extending parallel to each other are formed in the main body and the back plate in a symmetrical manner. The opposing faces of a flat multi-conductor cable are held in the grooves of the main body and the back plate, so that the cable is sandwiched between the main body and the back plate for electric connection between intended conductors of the flat multi-conductor cable and a device mounted on an upper face of the main body. The number of grooves of either of the main body and the back plate is at least one or more greater than the number of poles of the flat multi-conductor cable. Protrusions are provided in middle portions of alternate grooves of the back plate except the two endmost grooves, and block the alternate groove.

15 Claims, 13 Drawing Sheets

FLAT MULTI-CONDUCTOR CABLE CONNECTOR

BACKGROUND OF THE INVENTION

1. Field of the Invention

This invention relates to a flat multi-conductor cable connector, more particularly, to a connector for a flat multi-conductor cable which enables a change to be made to the circuit configuration within the connector and is suitably used to, for example, mount a LED unit made up of a plurality of LEDs.

2. Description of the Related Art

In a conventional technique for arrangement of various types of many devices having short mounting leads such as LED on a single flat cable, as shown in FIG. 1, the devices 2 are respectively mounted on substrates 1, and then the substrates 1 are connected to each other through a flat cable 4 with wire connectors 3. However, the operation conducted on site for placing the substrates 1 on arbitrarily portions of the flat cable 4 is disadvantageous from the viewpoint of quality control and operating efficiency. In addition, the mounting process involves the processes of soldering and checking, making it impossible to reduce the number of components and the manufacturing costs.

To avoid this, conventionally, attempts have been made to directly mount various types of devices on connectors connected to a flat cable without use of the substrate requiring the soldering process and the like.

On the other hand, a LED unit made up of a plurality of LEDs has, for example, the function of changing color. Therefore, a plurality of LED units are attached to a single flat multi-conductor cable, so that the color of light emitted from each LED unit can be selectively changed. In this manner, the widening of the scope of application of LEDs has been attempted. An example of such a LED unit is shown in FIG. 2. The LED unit 23 shown in FIG. 2 is made up of a set of three LEDs 27 as shown in FIG. 3. Since each of the three LEDs 27 has two terminals, the LED unit needs six terminals 18 in total.

However, when a plurality of types of LED units are connected to a flat multi-conductor cable, if the connectors used are of only one type, it is difficult in actuality to address various requirements that, for example, a circuit system is changed depending on the type of LED unit to change the color of light emitted from the LED unit. To solve this difficulty, a plurality of types of connectors are conventionally used. However, when, for example, the process of pressure-welding an electric wire conducted on site is taken into consideration, it is clear that the use of a plurality of types of connectors is disadvantageous from the viewpoint of quality control.

SUMMARY OF THE INVENTION

It is an object of the present invention to allow a change to be easily made to the configuration of an electric circuit within a connector in order to further improve the capabilities of a plurality of types of devices such as LED units to be connected to a flat multi-conductor cable. It is another object of the present invention to provide a flat multi-conductor cable connector which is designed for high reliability and is capable of achieving efficient mounting operation without a soldering process and the like.

DETAILED DESCRIPTION OF THE PREFERRED EMBODIMENT

Figure 4:
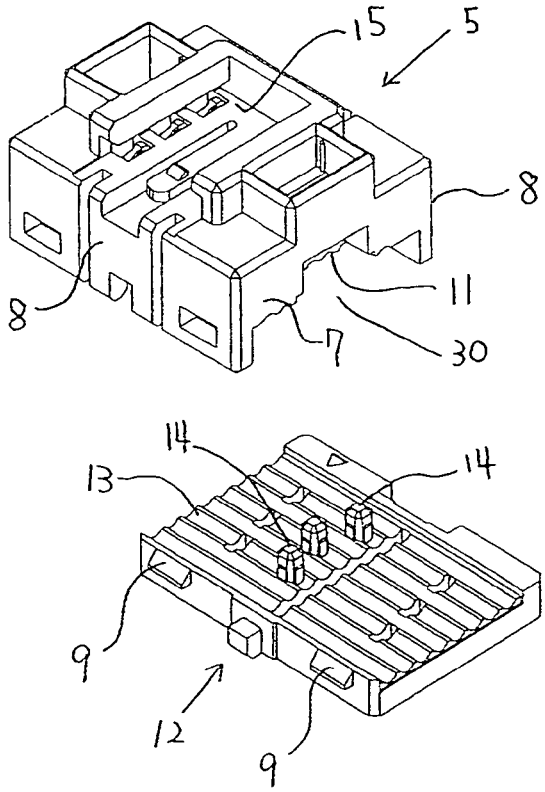
FIG. 4 is an exploded perspective view illustrating a first embodiment of a flat multi-conductor cable connector according to the present invention.
Figure 5:
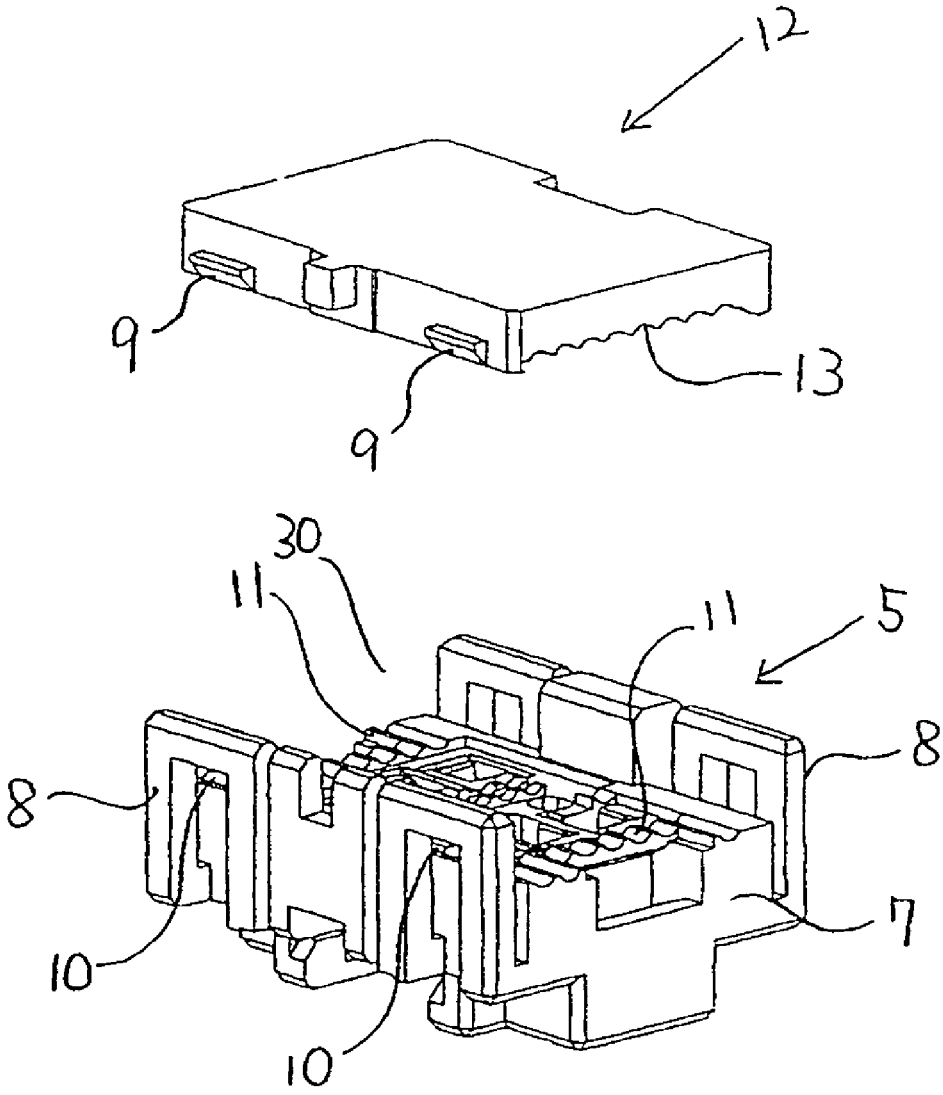
FIG. 5 is an exploded perspective view of the first embodiment shown in FIG. 4 when viewed from the back face of the connector.
Figure 6:
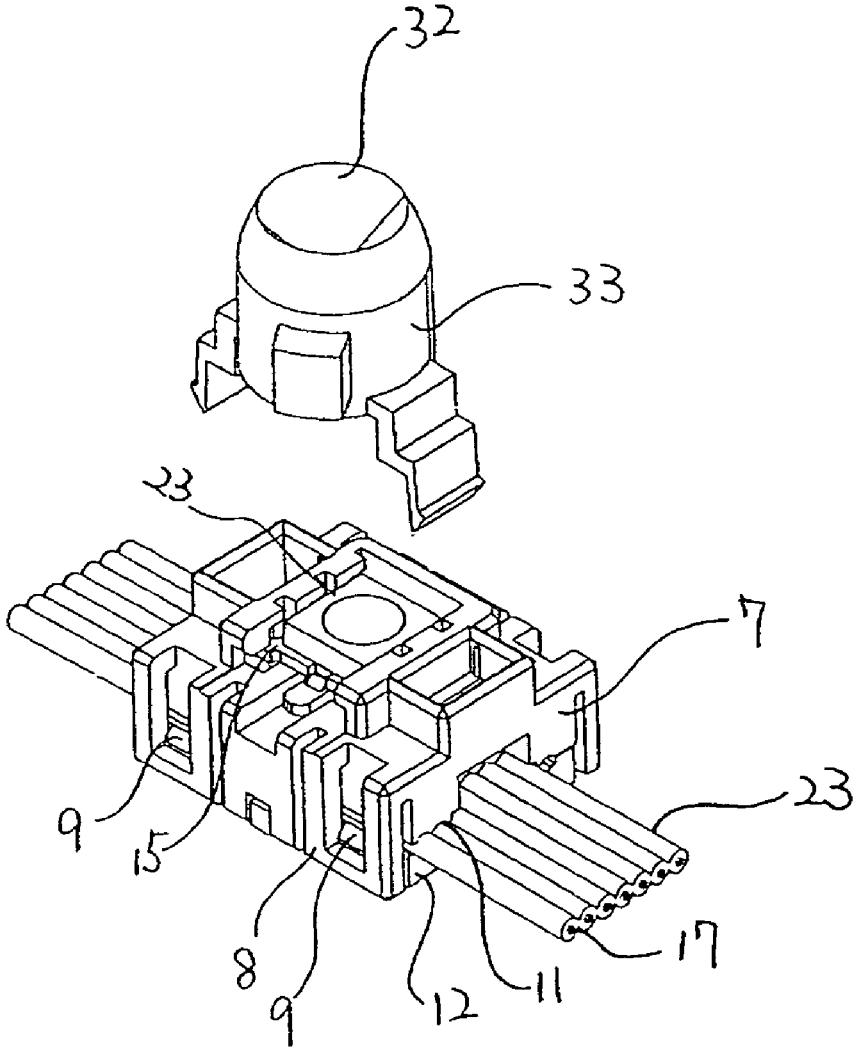
FIG. 6 is a perspective view of the assembled connector in the first embodiment illustrated in FIG. 4.

FIG. 4 is an exploded perspective view illustrating a flat multi-conductor cable connector according to the present invention. Similarly, FIG. 5 is an exploded perspective view of the flat multi-conductor cable connector shown in FIG. 4 turned upside down. FIG. 6 is a perspective view of the connector and the flat multi-conductor cable coupled to each other. In FIGS. 4 and 5, reference numeral 5 denotes the main body of the flat multi-conductor cable connector which is formed of a synthetic resin and shaped in a box form. The main body 5 has a quadrangle-shaped base 7 which has a large thickness and is provided with a mounting pocket 15 for mounting a device such as a LED unit 23 on the upper face of the main body 5. The main body 5 is provided integrally with side walls 8 extending downward from the opposing upper sides of the base 7. The main body 5 has a downward opening 30 formed in its underside face. In this embodiment, a lens 32 is attached through a lens barrel 33 above the mounting pocket 15, such that the optical axis can be optically changed for the light emitted from the LED unit 23. It goes without saying that, when a device to be mounted on the mounting pocket 15 is not the LED unit 23, the lens 23 is not necessary.

FIGS. 4 to 6 also show a back plate 12 which is fitted between the inner sides of the lower edges of the respective side walls 8 of the main body 5 to block the downward opening of the main body 5. The back plate 12 has engaging hooks 9 provided on the side faces. The engaging hooks 9 are respectively engaged with slits 10 correspondingly provided in the side walls 8 of the main body 5, with the result that the back plate 12 blocks the downward opening 30 of the main body 5.

The base 7 of the main body 5 has the reverse face in which a plurality of flat-multiconductor-cable holding grooves 11 are arranged parallel to each other. Each of the grooves 11 has an arc cross section in the longitudinal direction. The number of flat-multiconductor-cable holding grooves 11 must be at least one or more greater than the number of conductors 17 of the flat multi-conductor cable 26, that is, the number of poles. In the embodiment shown in FIGS. 4 to 6, the number of poles of the flat multi-conductor cable 26 is set at 7, thus providing 8 flat multiconductor-cable holding grooves 11. On the other hand, the back plate 12 also has flat-multiconductor-cable holding grooves 13 arranged in equal number and corresponding positions to the flat-multiconductor-cable holding grooves 11 of the main body 5, so that the flat cable 4 are sandwiched between the flat-multiconductor-cable holding grooves 11 and 13 such that the right face and the wrong face of the flat cable 4 are respectively fitted into the flat-multiconductor-cable holding grooves 11 and 13.

In addition, protrusions 14 are respectively formed in middle portions of the alternate grooves of the flat-multiconductor-cable holding groove 13 of the back plate 12 except the two endmost grooves 13, that is, in the middle portions of the third, fifth and seventh grooves 13 from the left in FIG. 4. The third, fifth and seventh flat-multiconductor-cable holding grooves 13 are divided by the protrusions 14. The protrusions 14 are provided in alternate grooves excepting the two endmost grooves. Specifically, when the 8 flat-multiconductor-cable holding grooves 13 are provided as in the embodiment, the three protrusions 14 are provided in the alternate grooves 13. When 9 flat-multiconductor-cable holding grooves 13 are provided, the four protrusions 14 are provided in the alternate grooves 13.

Figure 1:
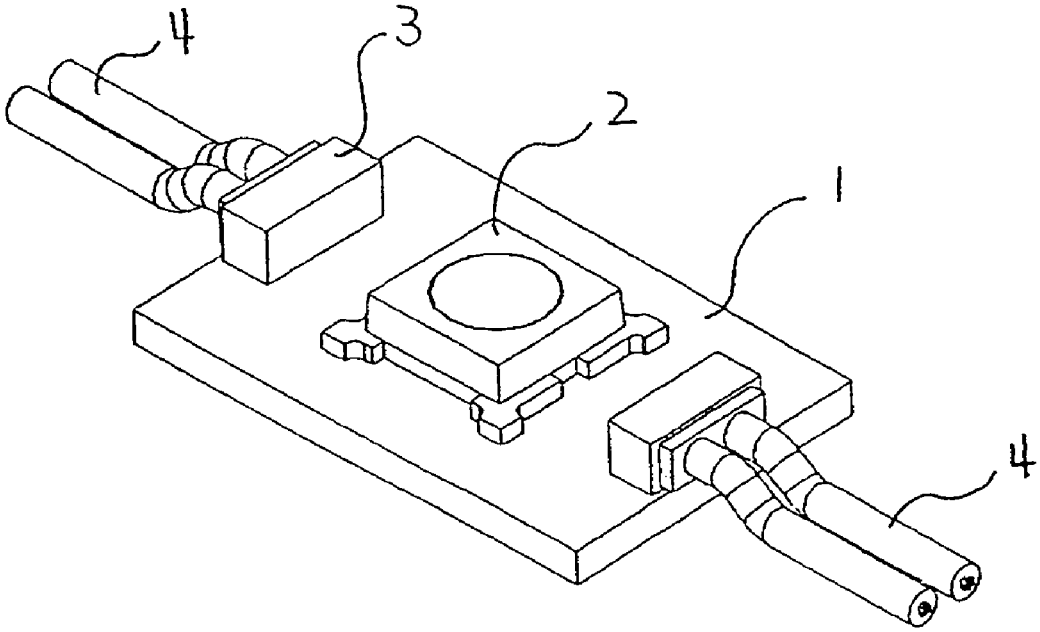
FIG. 1 is a perspective view of a conventional example of a flat cable connected to a device mounted on a substrate in related art.
Figure 2:
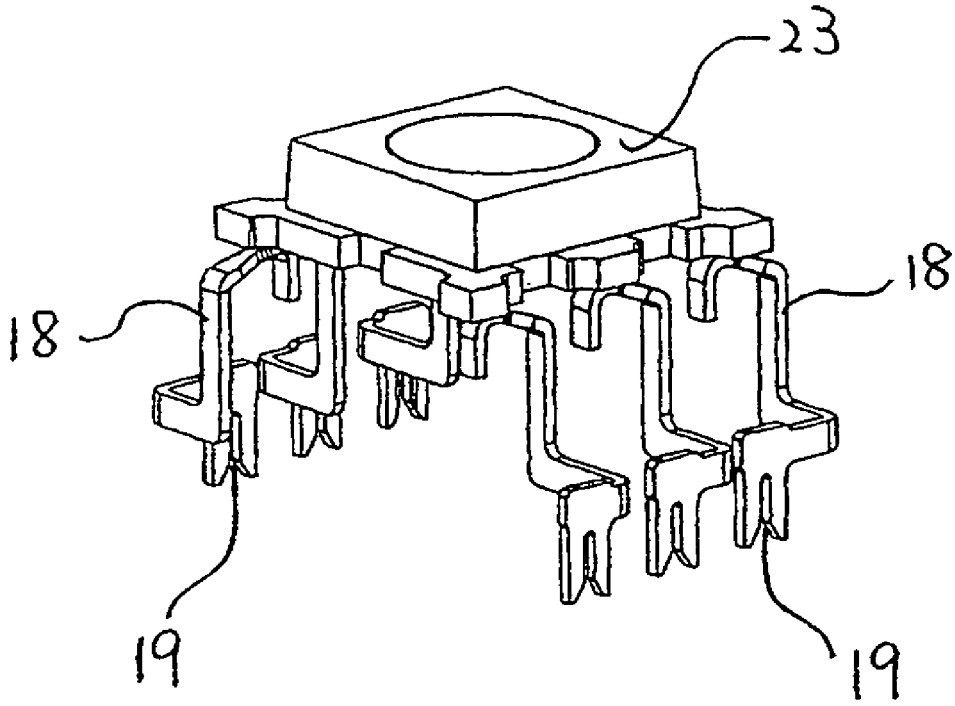
FIG. 2 is a perspective view of an example of a LED unit made up of a plurality of LEDs.
Figure 3:
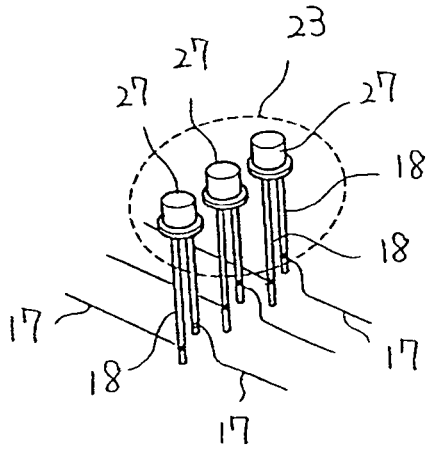
FIG. 3 is a schematic diagram illustrating a circuit of the LED unit shown in FIG. 2.
Figure 7:
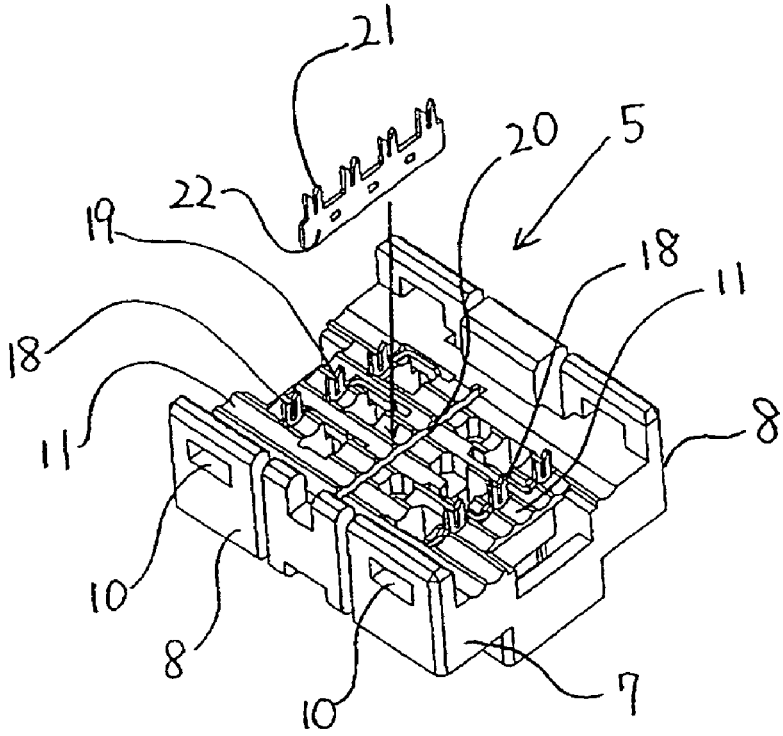
FIG. 7 is a perspective view of a main body in another embodiment when viewed from the back face.

As shown in FIG. 7, copper-alloy made terminals 18 are also built into the main body 5 in order to provide electric connection between the leads of the device mounted in the mounting pocket 15 and the corresponding conductors 17 of the flat multi-conductor cable 26. As shown in FIG. 2, the lower end of each terminal 18 is designed as a U-shaped pressure-contact 19 that makes contact with opposing sides of the conductor 17 so as to tightly hold the conductor 17.

Figure 8:
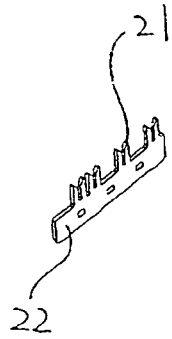
FIG. 8 is a perspective view of another example of a short-circuit conductive plate used in the embodiment shown in FIG. 7.

FIG. 7 also shows a slit 20 that is formed in the central portion of the base of the main body 5 and extends in the direction at right angles to the axis of the flat-multiconductor-cable holding groove 11, such that a short-circuit conductive plate 22 can be fitted into the slit 20. The short-circuit conductive plate 22 is equipped with pressure contacts 21 shaped in a comb form for tightly holding ones arbitrarily selected from the conductors 17 of the flat multi-conductor cable 26. The positions and the number of required pressure contacts 21 are selected, and thus the short-circuit conductive plate 22 can short-circuit the arbitrarily selected conductors 17. FIG. 8 illustrates another example of the short-circuit conductive plate 22.

EFFECTS OF THE INVENTION

Figure 9:
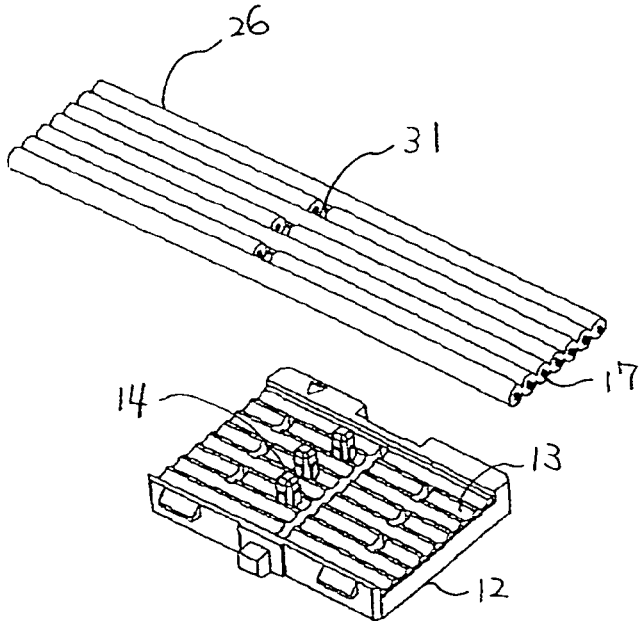
FIG. 9 is a perspective view illustrating the flat cable before being held on the back plate.
Figure 10:
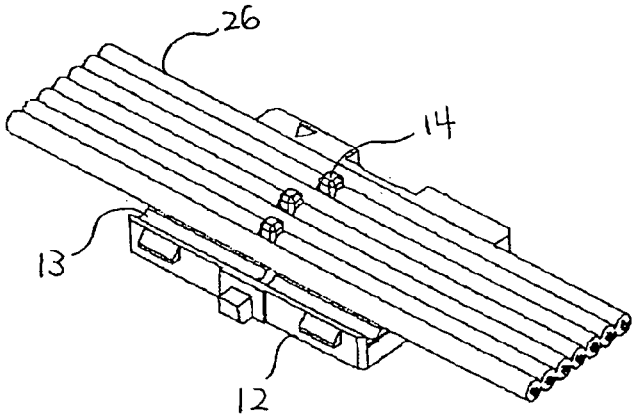
FIG. 10 is a perspective view illustrating the flat cable held on a back plate.
Figure 11:
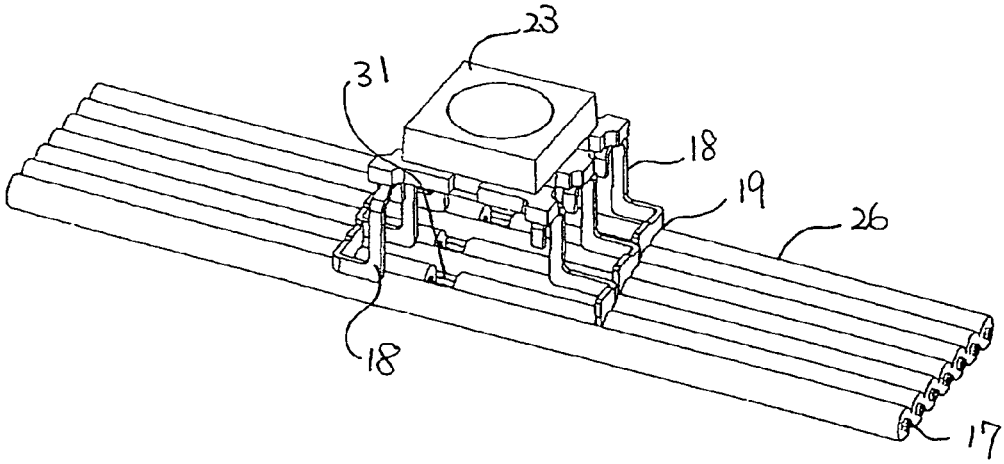
FIG. 11 is a perspective view illustrating the coupling between a conductor and a terminal when the back plate on which the flat cable shown in FIG. 10 is held is coupled to the main body.
Figure 12:
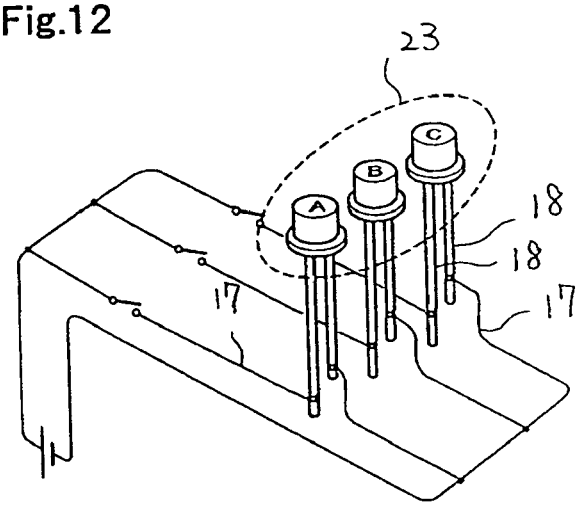
FIG. 12 is a schematic diagram illustrating a circuit configured when the flat multi-conductor cable shown in FIG. 11 is coupled to the LED unit.
Figure 13:
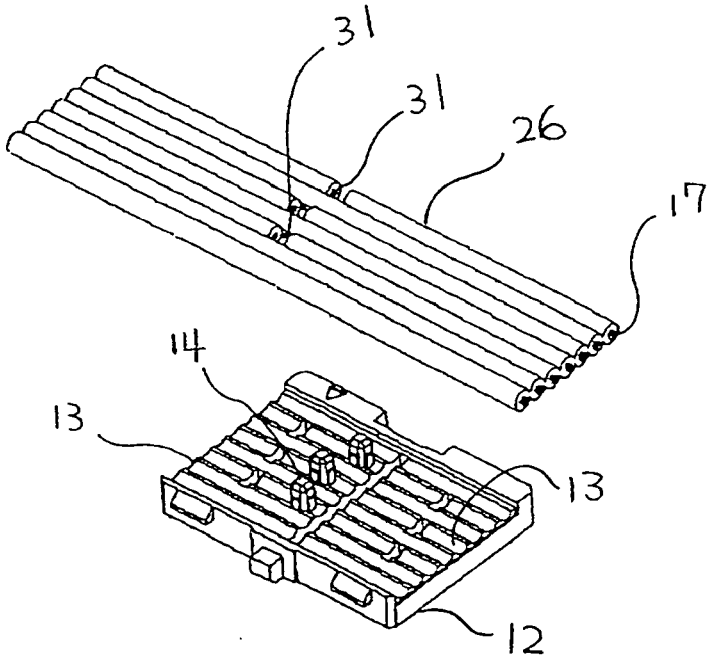
FIG. 13 is an exploded perspective view illustrating another combination of the flat multi-conductor cable and grooves formed in the back plate for holding the flat multi-conductor cable.
Figure 14:
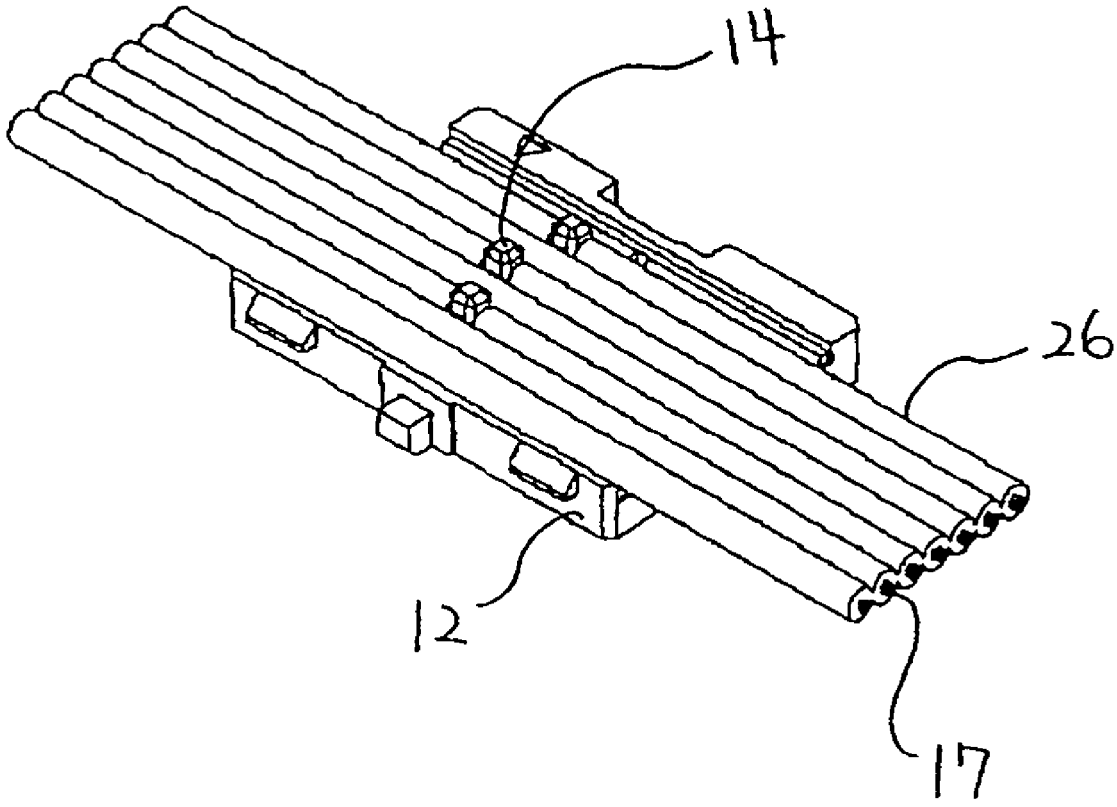
FIG. 14 is a perspective view of the flat multi-conductor cable shown in FIG. 13 coupled to the back plate.
Figure 15:
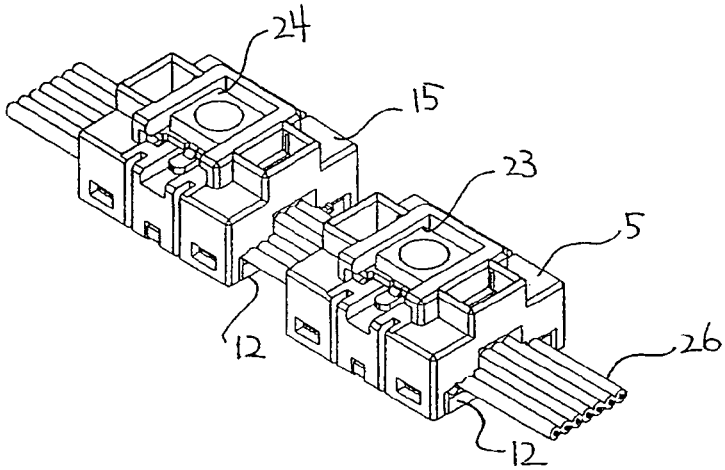
FIG. 15 is a perspective view of the flat multi-conductor cable connectors respectively mounted with the LED units of different systems and connected to the same flat multi-conductor cable.
Figure 16:
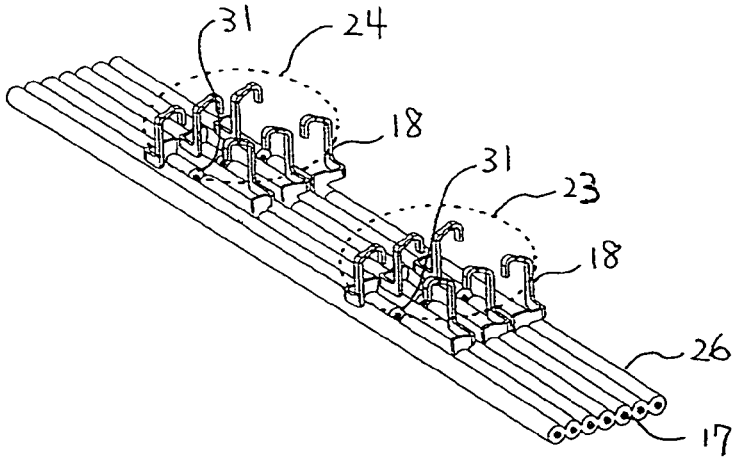
FIG. 16 is a diagram illustrating the coupling between the terminals and the conductors in FIG. 15.
Figure 17:
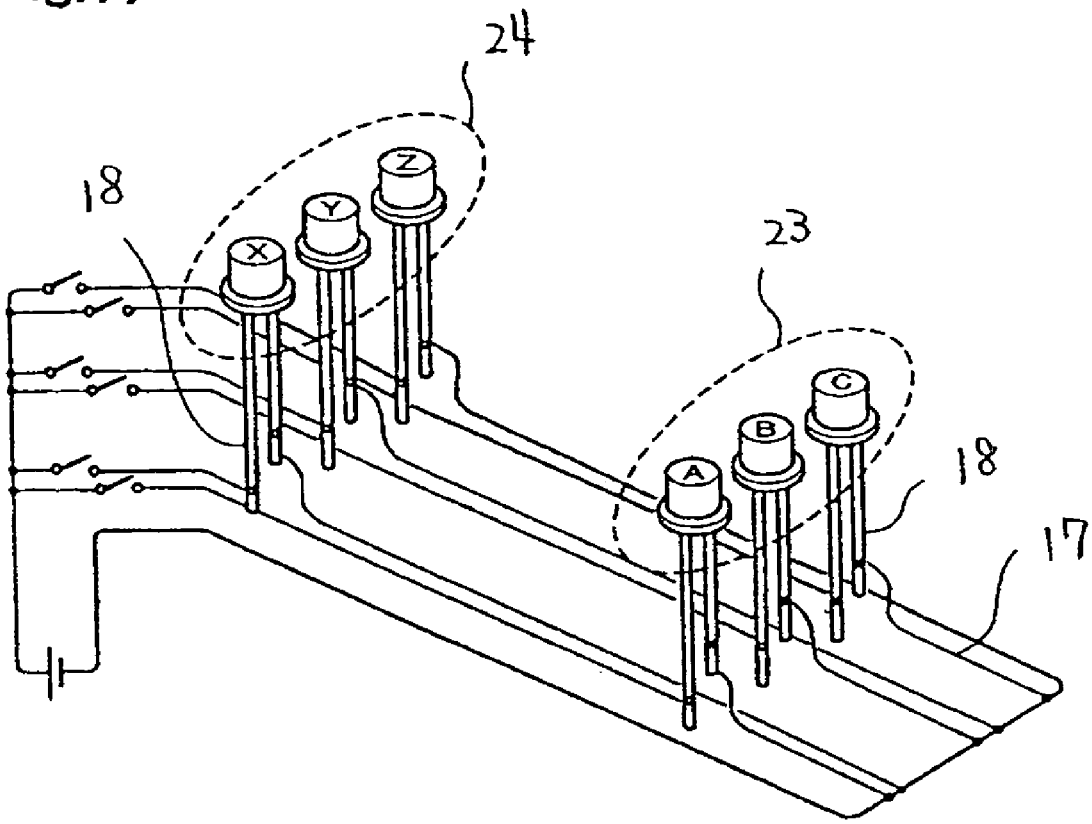
FIG. 17 is a schematic diagram illustrating the circuit configured in FIG. 16.
Figure 18:
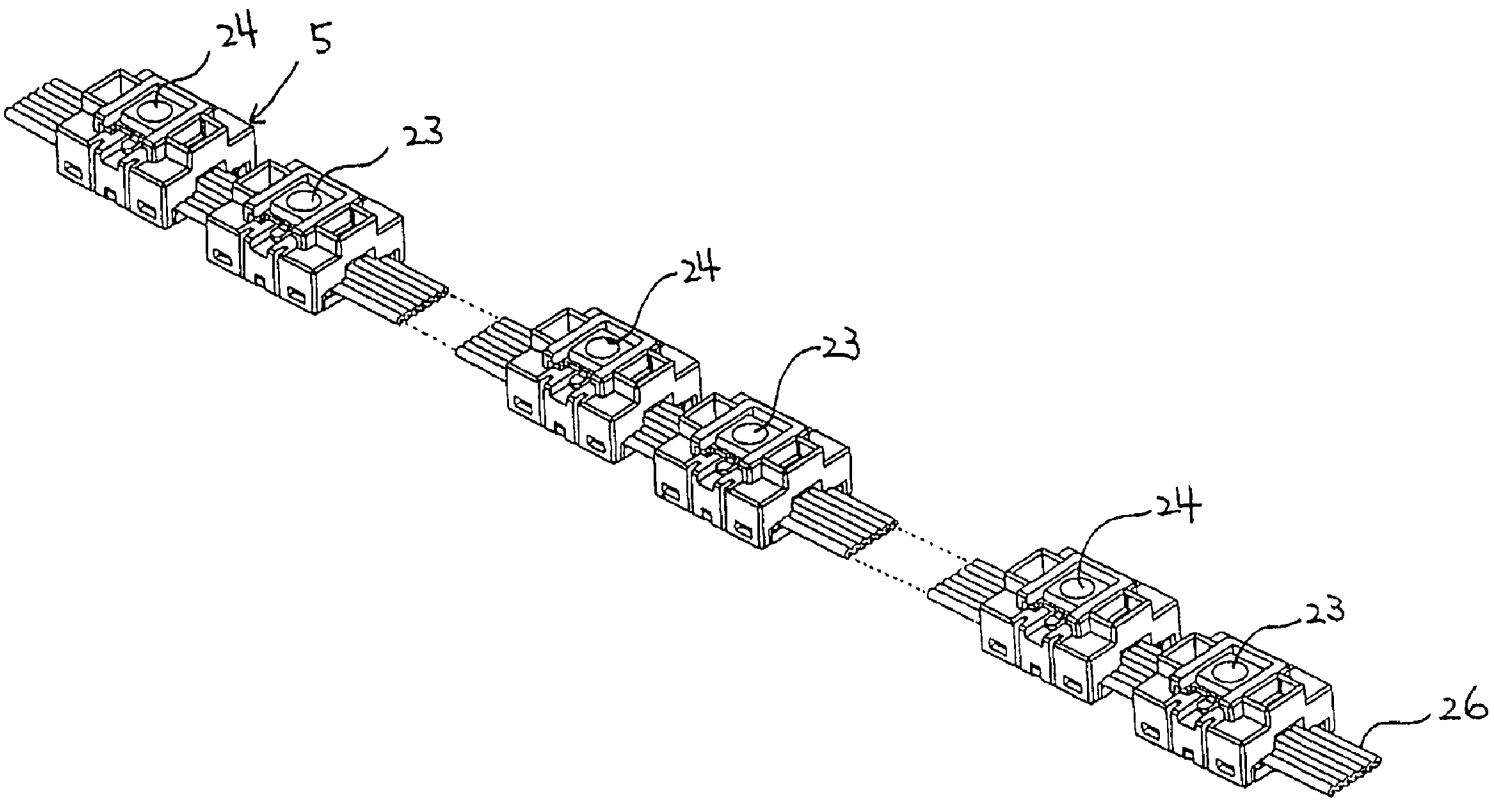
FIG. 18 is a perspective of an example of the use of a plurality of the flat multi-conductor cable connectors according to the present invention mounted on one flat multi-conductor cable.

As shown in FIG. 9, parts of the intended conductors 17 of the flat multi-conductor cable 26, together with their covers, are cut out to form cut portions 31. The flat multi-conductor cable 26 is laid on the flat-multiconductor-cable holding grooves 13 of the back plate 12 such that the protrusions 14 of the back plate 12 are fitted into the cut portions 31 as shown in FIG. 10. The flat multi-conductor cable 26 is sandwiched between the flat-multiconductor-cable holding grooves 11 of the main body 5 and the flat-multiconductor-cable holding grooves 13 of the back plate 12, so as to combine the main body 5 with the back plate 12 as shown in FIG. 6. As shown in FIG. 11, each of the intended conductors 17 is inserted into the corresponding pressure-contact 19 of the terminal 18, such that electric connection between the conductor 17 and the device such as the LED unit 23 mounted in the mounting pocket 15 provided in the upper face of the main body 5 is established to configure a circuit. FIG. 12 schematically shows a circuit formed in this manner. In the flat multi-conductor connector according to the present invention, the number of flat-multiconductor-cable holding grooves 11, 13 is at least one or more greater than the number of poles of the flat multi-conductor cable 26. This makes it possible to use the same type of connectors to connect two types of devices differing in circuit system from each other with the same flat multi-conductor cable. Specifically, for example, as shown in FIG. 15, a LED unit 23 made up of three LEDs A, B and C and another LED unit 24 made up of three LEDs X, Y and Z are connected to a flat multi-conductor cable 26, such that the LED unit 23 and the LED unit 24 can be independently turned on/off. For this purpose, the flat multi-conductor cable 26 is fitted into the flat-multiconductor cable holding grooves 13 of the back plates 12 which are to be respectively combined with the main bodies 5 on which the LED unit 23 and the LED unit 24 are respectively mounted, in which the position of the cable 26 in the holding grooves 13 for the LED unit 23 is displaced one groove from the position of the cable 26 in the holding grooves 13 for the LED unit 24, thereby achieving the positional relationship between the terminals 18 and the corresponding conductors 17 as shown in FIGS. 16 and 17. As a result, the LED unit 23 and the LED unit 24 can be independently turned on/off. Accordingly, as shown in FIG. 18, a plurality of the LED units 23 and 24 are able to be connected in series to the flat multi-conductor cable 26 and independently turned on/off. Alternatively, as shown in FIG. 7, because the short-circuit conductive plate 22 can be placed in the base 7 of the main body 5 for connecting each signal to the ground, the selections of the position and the number of pressure contacts 21 of the short-circuit conductive plate 22 makes a short circuit between the arbitrarily selected conductors 17, resulting in further various circuit configurations. In the embodiment, the number of poles of the flat multi-conductor cable 26 is 7 and the number of grooves in each set of flat-multiconductor-cable holding grooves 11 and 13 is 8. However, it goes without saying that the greater the number of poles of the flat multi-conductor cable 26, and the greater the number of flat-multiconductor-cable holding grooves 11, 13 is set than the number of poles of the flat multi-conductor cable 26, the more the circuit systems can be configured. A flat multi-conductor cable connector according to the present invention is capable of accepting a plurality of devices differing in circuit system, and also electrical connection is achieved by use of pressure contact techniques without the soldering process and the like. In consequence, the flat multi-conductor cable connector of the present invention has high reliability, can improve the operating efficiency, and is effective for particularly disposing a plurality of LED units on one flat multi-conductor cable. Accordingly, the flat multi-conductor cable connector can be used in various electrical products such as vehicle electrical equipment, household electrical appliances, audio products, and lighting fixtures for store display.

What is claimed is:

1. A flat multi-conductor cable connector comprising:

a main body comprising a plurality of flat-multi-conductor-cable holding grooves of an arc-shaped cross section formed in a face to extend parallel to each other in sidewardly adjacent relation to receive parallel conductors of a flat-multi-conductor cable; and a back plate matable with said main body comprising a plurality of flat-multi-conductor-cable holding grooves of an arc-shaped cross section formed in a face facing the main body to extend parallel to each other in sidewardly adjacent relation and arranged symmetrically to the flat-multi-conductor-cable holding grooves of the main body in opposing relation when said main body and said back plate are mated together, a right face and a wrong face of a flat multi-conductor cable being respectively held in the flat-multi-conductor-cable holding grooves of the main body and the flat-multi-conductor cable holding grooves of the back plate, so that the flat multi-conductor cable is sandwiched between the main body and the back plate for electric connection between intended conductors of the flat multi-conductor cable and an electrical device mounted on an upper face of the main body, each said conductor of said flat-multi-conductor cable being confined between a respective one of said flat-multi-conductor-cable holding grooves of said main body and an opposing one of said flat-multi-conductor-cable holding grooves of said back plate, said electrical device having a plurality of cable-piercing electrical contacts which each electrically connect to a respective one of said conductors when said main body and said back plate are mated together;

wherein the number of flat-multi-conductor-cable holding grooves of the main body and the back plate is at least one or more greater than the number of the conductors of the flat multi-conductor cable wherein said flat-multi-conductor cable is positionable within said flat-multi-conductor cable holding grooves in a selected one of a plurality of sidewardly adjacent cable positions, further comprising a plurality of protrusions in middle portions of alternate flat-multi-conductor-cable holding grooves of the flat-multi-conductor cable holding grooves, except the two endmost grooves, of the back plate, so as to block the alternate flat-multi-conductor-cable holding grooves wherein separated end portions of said flat-multi-conductor cable holding grooves are separated from each other on opposite sides of said middle portions, each of said electrical contacts being longitudinally aligned with a respective one of said projections in a respective one of said flat-multi-conductor cable holding grooves.

2. A flat multi-conductor cable connector according to claim 1, wherein the electrical device connected to the flat multi-conductor cable is a LED unit.

3. A flat multi-conductor cable connector according to claim 1, further comprising a short-circuit conductive plate provided in the main body for short-circuiting the intended conductors of the flat multi-conductor cable.

4. A flat multi-conductor cable connector according to claim 2, further comprising a mounting pocket formed in the upper face of the main body for mounting the LED unit, and a lens attached through a lens barrel above the mounting pocket.

5. A flat multi-conductor cable according to claim 1, wherein said electrical contacts of said electrical device project into a plurality of said alternate flat multi-conductor cable connector holding grooves.

6. A flat multi-conductor cable connector according to claim 1, wherein said flat multi-conductor cable has cut portions which separate longitudinally spaced conductor sections of said conductors, said protrusions being inserted into said cut portions between said spaced conductor sections, and said electrical contacts being electrically connected to said spaced conductor sections.

7. A flat multi-conductor cable connector according to claim 6, wherein at least a first group of said conductors engages said electrical contacts when said flat-multi-conductor cable is positioned in a first one of said cable positions, and a second group of said conductors engages said electrical contacts when said flat-multi-conductor cable is positioned in a second one of said cable positions.

8. A flat multi-conductor cable connector according to claim 1, wherein at least a first group of said conductors engages said electrical contacts when said flat-multi-conductor cable is positioned in a first one of said cable positions, and a second group of said conductors engages said electrical contacts when said flat-multi-conductor cable is positioned in a second one of said cable positions.

9. A flat multi-conductor cable connector according to claim 8, wherein said electrical device comprises a plurality of light units which are each powered through a respective plurality of said electrical contacts, wherein each of light units is powered by electrical connection to a different one of said conductors disposed in different ones of said alternate flat-multi-conductor-cable holding grooves.

10. A flat multi-conductor cable connector according to claim 8, wherein said conductors of said first and second groups are arranged in alternating relation such that either said first group of said conductors or said second group of said conductors is disposed in said alternate flat-multi-conductor-cable holding grooves dependent upon said multi-conductor cable being positioned in said first cable position or said second cable position.

11. A flat multi-conductor cable connector comprising:

a main body comprising a plurality of flat-multi-conductor-cable holding first grooves of an arc-shaped cross section formed in a face, said first grooves extending parallel to each other in sidewardly adjacent relation to receive parallel conductors of a flat-multi-conductor cable; and a back plate matable with said main body comprising a plurality of flat-multi-conductor-cable holding second grooves of an arc-shaped cross section formed in a face facing the main body, said second grooves extending parallel to each other in sidewardly adjacent relation and arranged symmetrically to the first grooves of the main body in opposing relation when said main body and said back plate are mated together, a right face and a wrong face of said flat multi-conductor cable being respectively held in the first grooves of the main body and the second grooves of the back plate, so that the flat multi-conductor cable is sandwiched between the main body and the back plate for electrical connection between selected conductors of the flat multi-conductor cable and an electrical device mounted on an upper section of the main body, each said conductor of said flat-multi-conductor cable being confined between a respective one of said first grooves of said main body and an opposing one of said second grooves of said back plate, said electrical device having a plurality of cable-piercing electrical contacts which each electrically connect to a respective one of said conductors when said main body and said back plate are mated together;

wherein the number of said first grooves of the main body and said second grooves of the back plate is at least one or more greater than the number of the conductors of the flat multi-conductor cable wherein said flat-multi-conductor cable is positionable within said first and, second grooves in a selected one of a plurality of sidewardly adjacent cable positions;

said conductors comprising first and second conductor groups wherein said conductors of said first conductor group alternate with said conductors of said second conductor group, said first group of said conductors engaging said electrical contacts when said flat-multi-conductor cable is positioned in a first one of said cable positions, and said second group of said conductors engages said electrical contacts when said flat-multi-conductor cable is positioned in a second one of said cable positions.

12. A flat multi-conductor cable connector according to claim 11, wherein said electrical device comprises a plurality of light units which are each powered through a respective plurality of said electrical contacts, wherein each of light units is powered by electrical connection to a different one of said conductors disposed in different ones of said first and second grooves.

13. A flat multi-conductor cable connector according to claim 12, further comprising a plurality of protrusions in middle portions of alternating pairs of said first and second grooves except the two endmost pairs of said first and second grooves, of the back plate, said protrusions separating opposite end portions of said first and second grooves, each of said electrical contacts being longitudinally aligned with a respective one of said projections in a respective one of said flat-multi-conductor cable holding grooves.

14. A flat multi-conductor cable connector according to claim 13, wherein said flat multi-conductor cable has cut portions which separate longitudinally spaced conductor sections of said conductors, said protrusions being inserted into said cut portions between said spaced conductor sections, and said electrical contacts being electrically connected to said spaced conductor sections.

15. A flat multi-conductor cable connector according to claim 14, wherein either said first conductor group or said second conductor group is disposed in said alternate pairs of said first and second grooves dependent upon said multi-conductor cable being positioned in said first cable position or said second cable position.

* * * * *